US005147411A

United States Patent [19]

Töpfl

[11] Patent Number: 5,147,411

[45] Date of Patent: Sep. 15, 1992

[54] PROCESS FOR IMPROVING THE YIELD AND THE WET FASTNESS PROPERTIES OF DYEINGS OR PRINTS PRODUCED WITH ANIONIC DYES ON CELLULOSE FIBRE MATERIAL USING ALKYL DI-ALLYL OR HALO-HYDROXYPROPYL AMMONIUM SALTS

[75] Inventor: Rosemarie Töpfl, Dornach, Switzerland

[73] Assignee: Ciba-Geigy Corporation, Ardsley, N.Y.

[21] Appl. No.: 667,720

[22] Filed: Mar. 11, 1991

[30] Foreign Application Priority Data

Mar. 15, 1990 [CH] Switzerland ..... 848/90

[51] Int. Cl.[5] ..... D06P 1/66; D06P 3/62; C09B 67/00; C07C 213/00

[52] U.S. Cl. ..... 8/606; 8/612; 8/680; 8/918; 564/291; 564/292

[58] Field of Search ..... 8/606

[56] References Cited

U.S. PATENT DOCUMENTS

| | | | |
|---|---|---|---|
| 4,286,959 | 9/1981 | Horn et al. | 8/524 |
| 4,583,989 | 4/1986 | Ueda et al. | 8/543 |
| 4,678,474 | 7/1987 | Ueda et al. | 8/543 |
| 4,838,896 | 6/1989 | Kissling et al. | 8/554 |
| 4,864,007 | 9/1989 | Schleusener | 526/218 |

FOREIGN PATENT DOCUMENTS

| | | |
|---|---|---|
| 3626410 | 2/1987 | Fed. Rep. of Germany . |
| 60-071786 | 4/1985 | Japan . |
| 61-133213 | 6/1986 | Japan . |

OTHER PUBLICATIONS

Abstract of Japan Publication No. 61133213 (Oct. 31, 1986).

Chem. Abstr., 103:124944a (1985).

*Primary Examiner*—A. Lionel Clingman

*Attorney, Agent, or Firm*—Edward McC. Roberts; Marla J. Mathias

[57] ABSTRACT

Process for improving the color yield and the wet fastness properties of dyeings or prints produced with anionic dyes on cellulose fibre material, in which the fibre material is treated before dyeing or during a dyeing with a quaternary ammonium salt of the formula

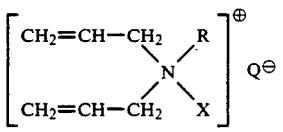

(1)

in which

R is $C_1$-$C_3$alkyl, X is the group

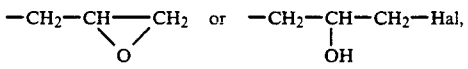

Hal is a halogen atom and $Q^{\ominus}$ is the anion of an aromatic sulfonic acid or a $C_1$-$C_3$alkylsulfate ion.

10 Claims, No Drawings

PROCESS FOR IMPROVING THE YIELD AND THE WET FASTNESS PROPERTIES OF DYEINGS OR PRINTS PRODUCED WITH ANIONIC DYES ON CELLULOSE FIBRE MATERIAL USING ALKYL DI-ALLYL OR HALO-HYDROXYPROPYL AMMONIUM SALTS

The present invention relates to a process for improving the yield and the wet fastness properties of dyeings or prints produced with anionic dyes on cellulose fibre material.

The process comprises treating cellulose fibre material before dyeing or during dyeing with a quaternary ammonium salt of the formula

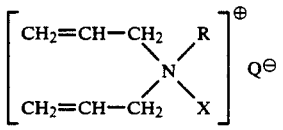

(1)

in which

R is $C_1$–$C_3$alkyl, X is the group

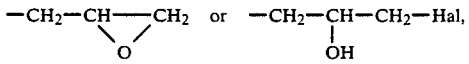

Hal is a halogen atom and $Q^{\ominus}$ is the anion of an aromatic sulfonic acid or especially a $C_1$–$C_3$alkylsulfate ion, for example benzenesulfonate, p-toluenesulfonate, chlorobenzenesulfonate, ethylsulfate ($CH_3CH_2SO_4$) or in particular methylsulfate ($CH_3SO_4$).

Suitable alkyl groups for R are methyl, ethyl, propyl, isopropyl. Ethyl and in particular methyl are preferred.

Examples of halogen are bromine, fluorine, iodine or preferably chlorine.

Specific ammonium salts of the formula (1) which can be used according to the invention are N-epoxy-2,3-propyl-N-methyl-N,N-diallylammonium methylsulfate, N-(3-chloro-2-hydroxypropyl)-N-methyl-N,N-diallylammonium methylsulfate, N-(3-chloro-2-hydroxypropyl)-N-ethyl-N,N-diallylammonium ethylsulfate, N-(3-chloro-2-hydroxypropyl)-N-methyl-N,N-diallylammonium p-toluenesulfonate, N-epoxy-2,3-propyl-N-ethyl-N,N-diallylammonium ethylsulfate and N-epoxy-2,3-propyl-N-methyl-N,N-diallylammonium p-toluenesulfonate.

The two first-mentioned representatives are particularly preferred.

The quaternary ammonium salts of the formula (1) are prepared by reacting a tertiary diallylamine of the formula

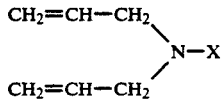

(2)

in which X is as already defined with an alkylsulfonate of the formula

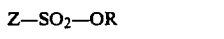

(3)

in which Z is an aryl radical or —OR and R is as already defined.

The quaternary ammonium salt thus prepared contains virtually no dihalogenopropanol, such as dichloropropanol.

Examples of suitable sulfonic esters are benzenesulfonates, p-toluenesulfonates, p-bromobenzenesulfonates, p-chlorobenzenesulfonates, p-nitrobenzenesulfonates and in particular dialkyl sulfates, such as diethyl sulfate and in particular dimethyl sulfate.

The reaction (quaternisation) is advantageously carried out at 30°–90° C., preferably 30°–60° C.

The quaternisation can be carried out in a nonpolar or polar solvent, for example water, dimethylformamide or ethanol.

The quaternised product is isolated in the usual manner.

The diallylamine compound of the formula (2) is prepared in a manner known per se by reacting diallylamine with an α-epihalogenohydrin, after which the halogenohydrin compound obtained is isolated. In the case where, for example, an alkali metal hydroxide, such as sodium hydroxide, is added to the reaction product, 1-diallylamino-2,3-epoxypropane is formed.

The epihalogenohydrin which is reacted with diallylamine can be any desired α-epihalognohydrin, for example epibromohydrin, epifluorohydrin, epiiodohydrin, β-methylepichlorohydrin or preferably epichlorohydrin.

Quaternary ammonium salts which can be used according to the invention are suitable in particular for improving the colour yield and the wet fastness properties of dyeings or prints, which are produced on cellulose fibre materials by means of anionic dyes, for example reactive or direct dyes.

The treatment of the cellulose material is preferably carried out semicontinuously by the cold pad-batch method. In this procedure, the cellulose material is impregnated with the treatment agent (fixing agent), for example by printing or preferably padding, and is then subjected to a fixing process by storing it. This application can be carried out before dyeing or during dyeing. The treatment is preferably carried out by the cold pad-batch process and in particular during dyeing.

The impregnation can be carried out at 20° to 50° C., but preferably at room temperature. The fixing process takes place by storing the impregnated material at room temperature for 4 to 48 hours, preferably 10 to 25 hours.

The preparations (padding liquors or printing pastes) contain the quaternary ammonium salt of the formula (1) advantageously in an amount of 10 to 70 g/l, preferably 25 to 50 g/l of active substance. In the padding liquors, the squeeze-off effect is advantageously 60 to 120% by weight.

Apart from the cationic, reactive compound of the formula (1), these preparations advantageously also contain alkaline compounds, for example potassium hydroxide or preferably sodium hydroxide. Preference is given to a 30% aqueous sodium hydroxide solution which is added to the preparation in an amount of 20 to 50 ml/l, preferably 25 to 40 ml/l.

Thus, the pH of the preparations can usually be 8 to 13.5, preferably 10 to 12.

The preparations can also contain further conventional additives, for example electrolytes, such as sodium chloride or sodium sulfate, urea, glycerol, thickeners, for example alginates, starch ethers or polyacrylates, reduction inhibitors, dispersants and wetting agents, homopolymers or copolymers of acrylamide or methacrylamide or graft polymers, such as are described in EP-A 111,454 and EP-A 363,319, and also antifoams and further cationic fixing agents, it also being possible for the latter to be fibre-reactive.

A suitable fibre material is regenerated or in particular natural cellulose, for example staple viscose, filament viscose, hemp, linen, jute or preferably cotton, and also fibre blends with synthetic fibres, for example those made of polyamide/cotton or in particular polyester/cotton.

The textile material can be used in any desired form, for example yarns, yarn hanks, woven, knitted or felted fabrics, preferably in the form of textile sheet structures, such as fabrics, stitched goods or carpets, which are made completely or in part of native, regenerated or modified cellulose.

The pretreatment of the cellulose fibre material by means of the cationic compounds of the formula (1) can be combined with other pretreatment operations. It is possible, for example, to add the cationic, reactive fixing agent to the alkaline bath in which untreated cotton is usually boiled before dyeing in order to remove impurities, thus making it possible to carry out purification and pretreatment by means of a fixing agent in one operation.

The treatment of the cellulose fibre material is preferably carried out simultaneously with dyeing. Dyeing is carried out using reactive dyes or preferably direct dyes by the cold pad-batch method, in which the impregnation can be carried out either by printing or by padding.

As a rule, the amount of dyes depends on the desired colour strength and is advantageously 0.1 to 100 g per litre of liquor, preferably 5 to 40 g/l of liquor.

When the cationic compound is used in a pretreatment of the cellulose fibre material, the dyeing can be produced by the exhaust process or by two-step processes, for example padding or printing, suitable padding processes being in particular the so-called pad-steam process, pad-fix process or the cold pad-batch method.

Suitable direct dyes are the conventional ones, for example the "Direct Dyes" mentioned in Colour Index, 3rd edition (1971), volume 2 on pages 2005–2478.

Reactive dyes are understood to mean the conventional dyes which form a chemical bond with cellulose, for example the "Reactive Dyes" mentioned in Colour Index, volume 3 (3rd edition, 1971) on pages 3391–3560 and in volume 6 (revised 3rd edition, 1975) on pages 6268–6345.

The process according to the invention gives uniform dyeings of high colour strength which are distinguished by an improved colour yield compared with the known dyeing processes not only in the pretreatment followed by dyeing but also in simultaneous application of the cationic fixing agent and the dye. It produces in particular dyeings on cellulose fibre material by means of direct dyes which show substantial improvement in the wet fastness properties. The shade and light fastness of the dyeings are not adversely affected. The process is particularly harmless to the environment, since the cationic, fibre-reactive fixing agent does not contain any troublesome by-product, such as dichloropropanol.

In the preparation and working examples which follow, the percentages are by weight, unless stated otherwise. The amounts relate to the commercially available, i.e. dilute material in the case of dyes and to the pure substance in the case of auxiliaries. The five-digit colour index numbers (C.I.) refer to the 3rd edition of the Colour Index.

PREPARATION EXAMPLES

EXAMPLE 1

247.6 g of dimethyl sulfate are added to 360 g of 1-diallylamino-3-chloro-2-hydroxypropane at 20°–40° C. over a period of 60 minutes with stirring, and the mixture is stirred at room temperature for 3½ hours. The reaction product of the formula

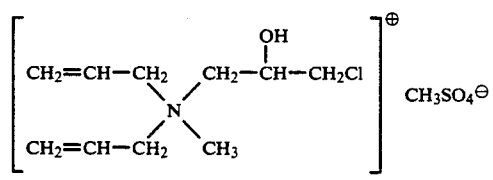

(4)

is viscous, clear and soluble in water. Amine number: 0.015

The N,N-diallyl-N-(3-chloro-2-hydroxypropyl)amine used in Example 1 is prepared as follows.

230 g of diallylamine are heated to 28° C. together with 222 g of α-epichlorohydrin and 7 g of water. The mixture is stirred at 28°–30° C. for 7 hours. The reaction product is then distilled at a b.p. of 68°–70° C. ($10^{-2}$ mm Hg).

This gives 361 g of N,N-diallyl-N-(3-chloro-2-hydroxypropyl)amine. Amine number; 5.4; epoxy number:

EXAMPLE 2

223 g of dimethyl sulfate are added to 270 g of 1-diallylamino-2,3-epoxypropane at 20° C. over a period of 60 minutes with stirring, and the mixture is stirred at room temperature for one hour.

The reaction product of the formula

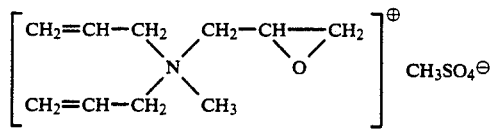

(5)

is viscous, clear and soluble in water. Amine number: 0.012, epoxy number: 3.52.

The 1-diallylamino-2,3-epoxypropane used in Example 2 is prepared as follows. 230 g of diallylamine are heated to 28° C. together with 222 g of α-epichlorohydrin and 7 g of water. The reaction mixture is stirred at 28°–30° C. for 7 hours. A solution of 112 g of sodium hydroxide in 182 g of water is then added at 20° C. The mixture is stirred at 22°–25° C. for 16 hours. It is then diluted with 400 g of water, and the organic phase is separated off. The latter is dried over potassium carbonate and distilled at a b.p. of 40°–42° C. ($10^{-2}$ mm Hg). The 1-diallylamino-2,3-epoxypropane obtained has an amine number of 6.48 and an epoxy number of 6.23.

EXAMPLE 3

108.9 g of diethyl sulfate are added to 108.8 g of 1-diallylamino-2,3-epoxypropane at 60°–85° C. over a period of 70 minutes with stirring, and the mixture is stirred at 75° C. for 1½ hours. The reaction product of the formula

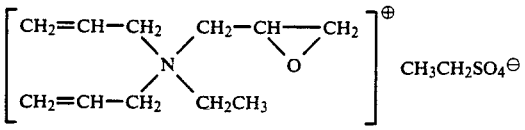

(6)

is viscous, clear and soluble in water. Amine number: 0.044, epoxy number: 3.15.

EXAMPLE 4

189.5 g of 1-diallylamino-3-chloro-2-hydroxypropane are dissolved in 126 g of acetone, 186 g of methyl p-toluenesulfonate are added at 30°–40° C. over a period of 2 hours, and the mixture is stirred at this temperature for 1½ hours.

The solvent is then removed.

The reaction product of the formula

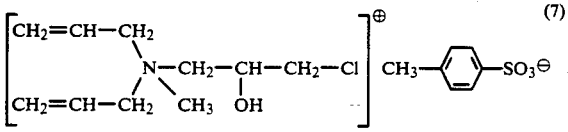

(7)

is viscous, clear and soluble in water. Amine number: 0.014.

WORKING EXAMPLES

EXAMPLE 1

20 g each of cotton cretonne, bleached and non-mercerised, are impregnated separately on a pad-mangle with one of the 4 following liquors containing per litre 1)
20 g of the dye Direct Red 80 C.I. 35780
32 ml of sodium hydroxide solution (30%)
35 g of the quaternary ammonium salt of the formula (4)

2)
12 g of the dye Direct Blue 71 C.I. 34140
32 ml of sodium hydroxide solution (30%)
35 g of the quaternary ammonium salt of the formula (4)

3)
12 g of the dye Direct Violet 66 C.I. 29125
32 ml of sodium hydroxide solution (30%)
35 g of the quaternary ammonium salt of the formula (4)

4)
20 g of the dye Direct Green 26 C.I. 34045
32 ml of sodium hydroxide solution (30%)
35 g of the quaternary ammonium salt of the formula (4)

The liquor pickup is in each case 80%. The fabrics are then rolled up while wet and packed in an airtight manner and stored at room temperature for 18 hours. The goods are then rinsed with cold and hot water and dried.

Of these 4 dyeings, the following fastness properties are tested:

Fastness to wet pressing (SN ISO 105-X11)
ISO C2S wash (ISO 105-C06)

in which the corresponding dyeings of the same strength which in each case were obtained without adding the quaternary ammonium salt of the formula (4) are also tested at the same time.

Table 1 below shows the fastness ratings.

TABLE 1

| Dyeings | g/l of dye | Fastness to wet pressing | ISO C2S wash: Change in shade | ISO C2S wash: Bleeding on cotton |
|---|---|---|---|---|
| (1) without | 45 | 3–4 | 4 | 2 |
| with | 20 | 5 | 5 | 3–4 |
| (2) without | 16 | 2 | 4 | 2 |
| with | 12 | 5 | 5 | 5 |
| (3) without | 25 | 2–3 | 4–5 | 4 |
| with | 12 | 4–5 | 5 | 5 |
| (4) without | 35 | 4–5 | 4–5 | 3–4 |
| with | 20 | 5 | 5 | 5 |

Similar results are obtained by using in each case the same amount of the quaternary ammonium salts of the formulae (6) and (7) during dyeing instead of the quaternary ammonium salt of the formula (4).

EXAMPLE 2

20 g each of a knitted cotton fabric, bleached and mercerised, are impregnated separately on a pad-mangle with one of the 4 liquors below which contain per litre 1)
25 g of a dye of the formula

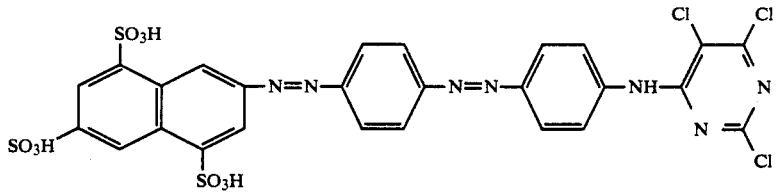

(101)

50 g of the quaternary ammonium salt of the formula (5)
40 ml of sodium hydroxide solution (30%)
100 g of urea and
3 g of the sodium salt of 3-nitrobenzenesulfonic acid 2)
25 g of a dye of the formula

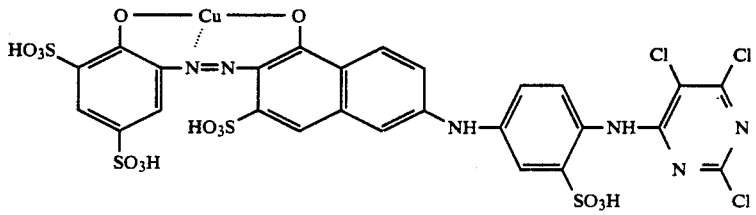

(102)

50 g of the quaternary ammonium salt of the formula (5)
40 ml of sodium hydroxide solution (30%)
100 g of urea and
3 g of the sodium salt of 3-nitrobenzenesulfonic acid 3)
25 g of a dye of the formula (103)

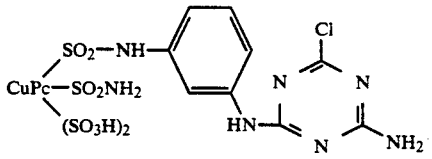

50 g of the quaternary ammonium salt of the formula (5)
40 ml of sodium hydroxide solution (30%)
100 g of urea and
3 g of the sodium salt of 3-nitrobenzenesulfonic acid 4)
25 g of a dye of the formula (104)

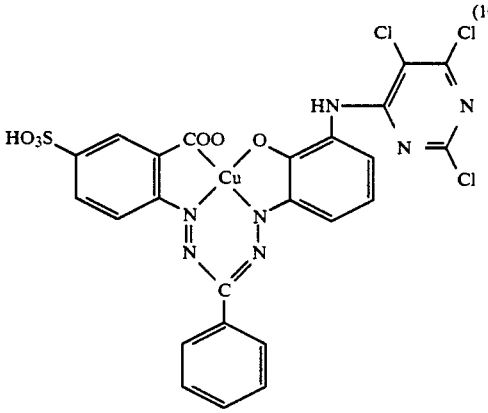

50 g of the quaternary ammonium salt of the formula (5)
40 ml of sodium hydroxide solution (30%)
100 g of urea and
3 g of the sodium salt of 3-nitrobenzenesulfonic acid.

The liquor pickup is in each case 100%. The fabrics are then rolled up while wet, packed in an airtight manner and stored for 18 hours.

The goods are then rinsed with cold and hot water and dried.

Of these 4 dyeings, the fastness to wet pressing and the ISO C2S wash are tested, and corresponding dyeings of the same strength, each obtained with more dye and in each case without adding the quaternary ammonium salt of the formula (5), are also tested at the same time.

In Table 2 below, the fastness ratings are compared.

TABLE 2

| Dyeings | g/l of dye | Fastness to wet pressing | ISO C2S wash Change in shade | ISO C2S wash Bleeding on cotton |
|---|---|---|---|---|
| (1) without | 40 | 4–5 | 5 | 4–5 |
| with | 25 | 5 | 5 | 4–5 |
| (2) without | 37 | 4 | 5 | 4–5 |
| with | 25 | 5 | 5 | 4–5 |
| (3) without | 35 | 4–5 | 5 | 4 |
| with | 25 | 5 | 5 | 5 |
| (4) without | 38 | 4–5 | 5 | 5 |
| with | 25 | 5 | 5 | 5 |

EXAMPLE 3

20 g each of a cotton knitted fabric, bleached and mercerised, are padded at a liquor pickup of 90% with a preparation containing per litre
35 g of the quaternary ammonium salt of the formula (4) and
30 ml of sodium hydroxide solution (30%).

After padding, the fabric is rolled up while wet and stored in a plastic sack at room temperature for 18 hours. The goods are then rinsed with cold and hot water.

The pretreated fabric is wetted together with 20 g of untreated fabric in an aqueous dyeing liquor at 50° C. which contains 1% of the dye Direct Blue 71 C.I. 43140 at a liquor ratio of 40:1. The temperature is raised to 98° C. over a period of 30 minutes, and the dyeing is carried out at this temperature for 45 minutes.

This gives 2 pieces of fabric of which the pretreated piece has been dyed in a deep blue colour, while the unpretreated material is only slightly coloured.

EXAMPLE 4

The fabric pretreated according to Example 3 is wetted together with 20 g of unpretreated fabric at 98° C. in an aqueous liquor which contains 1% of the dye of the formula (105)

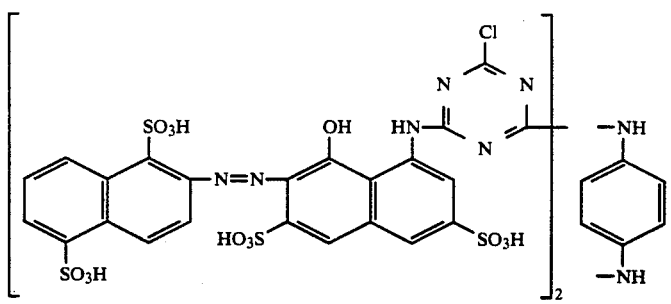

at a liquor ratio of 30:1. The temperature is reduced to 85° C. over a period of 30 minutes,
5 g/l of calcined sodium carbonate and
2 ml/l of sodium hydroxide solution (30%)
are added, and the material is treated at 85° C. for another 45 minutes. The dyeings are then rinsed in boiling water for 5 minutes.

This gives 2 fabrics of which the pretreated fabric has been dyed in a deep red colour, while the unpretreated material has only been dyed in a slightly pink colour.

EXAMPLE 5

The fabric pretreated according to Example 3 is wetted together with 20 g of unpretreated fabric and 20 g of a fabric treated in the same manner but only with 30 ml/l of sodium hydroxide solution (30%), in an aqueous liquor at 50° C. which contains 1% of a dye of the formula

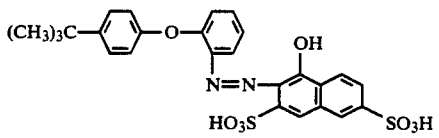

(106)

at a liquor ratio of 40:1. The material is then dyed at 50° C. for 40 minutes and then rinsed with warm water for 5 minutes. This gives 3 fabrics of which the fabric pretreated according to Example 3 has been dyed in a deep red colour, while the 2 other fabrics are only slightly coloured.

What is claimed is:

1. A process for improving the colour yield and the wet fastness properties of dyeings or prints produced with anionic dyes on cellulose fibre material, which process comprises treating the fibre material before dyeing or during dyeing with a quaternary ammonium salt of the formula

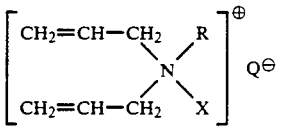

(1)

in which

R is $C_1$-$C_3$alkyl,

X is the group

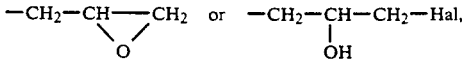

Hal is a halogen atom and $Q^{\ominus}$ is the anion of an aromatic sulfonic acid or a $C_1$-$C_3$alkylsulfate ion.

2. A process according to claim 1, wherein in formula (1) R is methyl or ethyl.

3. A process according to claim 1, wherein in formula (1) X is the chlorohydrin group

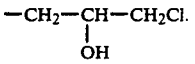

4. A process according to claim 1, wherein in formula (1) $Q^{\ominus}$ is the methylsulfate ion or ethylsulfate ion.

5. A process according to claim 1, wherein in formula (1) R is methyl, X is

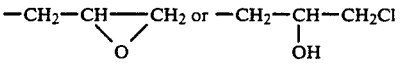

and $Q^{\ominus}$ is the methylsulfate ion.

6. A process according to claim 1, wherein the quaternary ammonium salt is N-(3-chloro-2-hydroxypropyl)-N-methyl-N,N-diallylammonium methysulfate.

7. A process according to claim 1, wherein the treatment is carried out semicontinuously in accordance with the cold pad-batch method.

8. A process according to claim 7, wherein the treatment is carried out during the dyeing.

9. A process according to claim 1, wherein the treatment is carried out from an alkaline medium.

10. A process according to claim 1, wherein the treatment is carried out to improve the colour yield and the wet fastness properties of dyeings produced with direct dyes.

* * * * *